US005640721A

United States Patent [19]

Jackson

[11] Patent Number: 5,640,721

[45] Date of Patent: Jun. 24, 1997

[54] SWEATBAND WITH WIPING TOWEL

[75] Inventor: Robert Charles Jackson, Long Beach, Calif.

[73] Assignee: Robert C. Jackson, Long Beach, Calif.

[21] Appl. No.: 439,088

[22] Filed: Apr. 20, 1995

[51] Int. Cl.[6] ..... A42C 5/02

[52] U.S. Cl. ..... 2/171; 2/209.13; 2/DIG. 11

[58] Field of Search ..... 2/7, 170, 171, 2/171.2, 181, DIG. 11, 209.13, 209.14; 607/109, 110

[56] References Cited

U.S. PATENT DOCUMENTS

| | | | |
|---|---|---|---|
| 3,815,610 | 6/1974 | Winther | 607/109 |
| 4,481,681 | 11/1984 | Hanklin . | |
| 4,502,156 | 3/1985 | Wishman . | |
| 4,576,169 | 3/1986 | Williams | 607/109 |
| 4,630,317 | 12/1986 | Brown . | |
| 4,638,512 | 1/1987 | Frankel . | |
| 4,712,254 | 12/1987 | Daigle . | |
| 4,723,325 | 2/1988 | Perry . | |
| 4,811,430 | 3/1989 | Janusz . | |
| 4,833,734 | 5/1989 | Der Estephanian . | |
| 4,856,116 | 8/1989 | Sullivan . | |
| 4,937,885 | 7/1990 | Gregg . | |
| 4,993,080 | 2/1991 | Doty . | |
| 5,033,122 | 7/1991 | Smith . | |
| 5,062,157 | 11/1991 | Muta . | |
| 5,088,126 | 2/1992 | Mathis . | |
| 5,129,106 | 7/1992 | Liou . | |
| 5,146,630 | 9/1992 | Richard . | |
| 5,331,686 | 7/1994 | Marshall . | |
| 5,395,400 | 3/1995 | Stafford et al. | 607/109 |

*Primary Examiner*—Diana Biefeld

[57] ABSTRACT

A strong, lightweight, soft, pliable, perspiration absorbent, economically disposable, foldable to a small packageable size, and reusable, sweatband (15) formed from a unitary body member comprising a perspiration absorbing pad (4) with drain channel (5) and a perspiration absorbing see through removable wiping towel/veil/windscreen (8) which can be protected from perspiration by a removable perspiration shield (14) provided in the pocket (7) of the sweatband to prevent the removable wiping towel (8) from becoming wet from perspiration if the wearer prefers not to have the wiping towel wet. Money, identification, packaged antimicrobial wipes and other items may also be carried in the sweatband pocket (7). The folded, porus, see through, removable wiping towel/veil/windscreen (8), can be easily removed by one hand from the sweatband through a access opening (12) located on the front face of the sweatbands second elongated envelope (2). The sweatband can be firmly installed around all human head sizes by pulling the sweatband tie straps (9) through a mechanical clamping device (13) which will hold the tie straps (9) firmly in place and allow the wearer to adjust the tension on the sweatband around the head while it is being worn. The excess tie strap material formed after adjusting the sweatband on the head may also be tucked between the head and the tie strap portion which surrounds the head, if the wearer chooses not to have the loose tie strap material protruding like a pony tail from the sweatband, in back of the head.

1 Claim, 5 Drawing Sheets

SWEATBAND WITH WIPING TOWEL

BACKGROUND OF THE INVENTION

1. Field of the Invention

The present invention relates to sweatbands worn about the human head, and in particular, to economically disposable and size adjustable sweatbands which fit all human head sizes and have the ability to adjust the tension of the sweatband on all head sizes to the wearer's desire without having to remove the sweatband from the head.

2. Prior Art market will absorb and prevent forehead perspiration from flowing down into the eyes but lack the ability to wipe away perspiration from other parts of the body, including around the eyes, nose, mouth and neck without having to remove the sweatband from the head.

This sweatband invention is unique in many ways from previous sweatband designs and functions. These differences are best summarized in the Prior Art—Comparison Chart of Features.

Prior Art - Comparison Chart of Features

Sweatband with Wiping Towel (*)
By
Robert C. Jackson

Definitions for abbreviations and comments used in chart below:

| | |
|---|---|
| PAP: | Perspiration Absorbing Pad |
| DC: | Drain Channel |
| PS: | Perspiraton Shield |
| WT: | Wiping Towel (FIG. 1 shows both the folded and unfolded positions) |
| WTA: | Wiping Towel Envelope and Access Opening |
| CP: | Carrying Pocket |
| SA: | Size Adjustable (to all head sizes) |
| MTC: | Mechanical Tension Control (while being worn on the head) |
| DISP: | Disposable (low cost product) |

Note: For a detailed explanation of the above items, refer to the patent specifications and drawing figures.

| U.S. Pat # | PAP | DC | PS | CP | WT | WTA | SA | MTC | DISP |
|---|---|---|---|---|---|---|---|---|---|
| (*) | ✓ | ✓ | ✓ | ✓ | ✓ | ✓ | ✓ | ✓ | ✓ |
| 4,481,681 | ✓ | | | | | | ✓ | | |
| 4,502,156 | ✓ | | ✓ | | | | ✓ | | |
| 4,630,317 | ✓ | | | | | | ✓ | | |
| 4,638,512 | | ✓ | | | | | ✓ | | |
| 4,712,254 | ✓ | | | (1) | | | ✓ | ✓ | |
| 4,723,325 | | | | | ✓ | | ✓ | | |
| 4,811,430 | ✓ | | | (2) | | | ✓ | | |
| 4,833,734 | ✓ | | | | | | ✓ | | ✓ |
| 4,856,116 | ✓ | | | | | | ✓ | | |
| 4,937,885 | | | | | | | ✓ | ✓ | |
| 4,993,080 | ✓ | | | | | | ✓ | | ✓ |
| 5,033,122 | ✓ | | | | | | ✓ | | ✓ |
| 5,062,157 | | | | | ✓ | | ✓ | | |
| 5,088,126 | ✓ | | | | | | ✓ | | ✓ |
| 5,129,106 | | | | | | | ✓ | | |
| 5,146,630 | ✓ | | | (3) | | | ✓ | | |
| 5,331,686 | ✓ | | | | | | ✓ | | ✓ |
| FIG. # | 2 | 3 | 6 | 6 | 1 | 4 | 5 | 5 | NA |

Note: Figure numbers refer to attached drawings.

Comments (1), (2), and (3) related to chart supra:

Prior art sweatbands do not lend themselves to carrying other items in a pocket other than what is specifically mentioned in the art, nor could other items be easily removed from the prior art sweatband pockets, without having to remove the sweatband from the head.

(1) U.S. Pat. No. 4,712,254 describes a pocket on the inside of the headband, facing downward. It is provided in order to accommodate a permanently attached eye piece mounting bracket, with tracks, for the attachment of an eyepiece.

(2) U.S. Pat. No. 4,811,430 also has a eye shield pocket sewn onto the inside of the headband which opens below and behind the top edge of the headband.

(3) U.S. Pat. No. 5,146,630 consists of a multi-layered cloth sweatband with a built-in flap type of pocket, which is provided in order to carry a sealed removable package containing a moisture absorbing chemical. The pocket is also on the inside of the sweatband, below and behind the top edge of the sweatband, thus making it impractical to carry items, as mentioned in this invention, which would be readily accessible to the wearer without having to remove the sweatband from the head in order to gain access to the pocket.

Human head worn sweatbands are typically simple devices made from cloth materials. Some are hand tied about the head and some have an elastic band sewn into the sweatband. The elastic allows the sweatband to expand to certain head sizes. Presently available sweatbands on the The current invention offers a sweatband which can be adjusted to fit all human head sizes. A mechanical clamp device combined with the sweatbands tie straps allows the wearer to adjust the size and tension of the sweatband both during installation and while wearing the sweatband on the head, for optimum comfort at all times. In addition, a folded removable wiping towel is incorporated into the sweatband which offers additional perspiration absorbing qualities as a part of the sweatband and the ability to serve as a readily available wet or dry towel for wiping away perspiration and other undesirable elements both on and off the wearer's body when it is removed from the sweatband, without having to remove the sweatband from the head. This feature is desirable because the body will continue to perspire for a time period after an event which initially caused the person to perspire, thus the exceptional features of this sweatband can be fully utilized in combination with leaving the sweatband on the head for the continuing protection and comfort of the wearer. The removable wiping towel also offers see through protection from the sun as a veil and cold air as a windscreen, when it is removed from the sweatband, unfolded, and tucked back into the sweatband across the face, thus serving as a wet or dry cooling device for the skin surfaces, or as a protective covering from the effects of cold weather. No other device is known which offers these features, relative to sweatbands.

SUMMARY OF THE INVENTION

This sweatband creation for the head provides the wearer with eye protection from perspiration, wind, dirt, mud, sand, dust, and other undesirable elements. The protection is provided in the form of a multi-folded removable wiping towel contained within the sweatband which can be easily removed while wearing the sweatband and unfolded for use as a cooling see through veil, breathe through filter, windscreen, and wiping towel. The sweatband is size adjustable to the head and has a means to adjust the tension of the sweatband around the wearer's head while being worn. This sweatband creation also incorporates a removable perspiration shield in a pocket of the sweatband which will prevent the wearer's perspiration from soaking into the removable wiping towel if the wearer prefers to have a dry wiping towel. The perspiration shield can be easily removed from the sweatband pocket while wearing the sweatband on the head to allow the folded wiping towel installed in the sweatband to be moistened by the wearer's perspiration, if the wearer prefers to have the advantages of a wet wiping towel. The sweatband creation is economical to manufacture, lightweight, and folds neatly for packaging and carriage.

OBJECTS OF THE INVENTION

The object of this sweatband invention is to provide the wearer with a comfortably to wear, economically discardable sweatband with a removable wiping towel which will protect the eyes and remove perspiration and other undesirable elements from both on and off the wearer's body, such as suntan lotions which can also intrude into the eyes, nose and mouth areas in combination with perspiration. The removable wiping towel may also be coated during the sweatband manufacturing process with a moisture activated, non-toxic, non-stinging astringent. The astringent could be provided for the purpose of killing off virus and bacteria while wiping exposed skin surfaces with the wiping towel.

The object of this sweatband invention is that it to be further used in athletic/recreational activities, work, and work related occupations which are exposed to such health hazards as blood born pathogens. It should be explained that emergency, law enforcement, sanitary, and investigative personnel are required per OSHA requirements to wear non-porus protective clothing while performing their duties. An example may be those duties and activities associated with the investigation of an aircraft crash scene. The protective clothing used in such investigations can be hooded, often times causing the wearer to perspire profusely while worn. This sweatband creation offers both protection and comfort from the effects of perspiration, thereby increasing the wearer's endurance. For the investigator the removable wiping towel can also provide a readily available means to remove potential health hazards such as virus laden dry blood particulate from skin surfaces around the goggles, and respirator, prior to removing such equipment. Packaged antimicrobial wipes, commercially available, can also be placed protruding from the sweatband pocket for quick access by the investigator. The perspiration soaked, folded wiping towel in the sweatband can also be easily removed from the sweatband and unfolded, with the corners of the wiping towel tucked between the sweatband and the sides of the wearer's forehead to serve as a cooling veil for people who suffer the effects of excessive heat build-up. In cold weather this sweatband creation provides the wearer with comfort and warmth as it protects the wearer from the cold effects of the weather. The porus, see through, wiping towel, serves as a nose wipe or windscreen and may be bunched or folded together and held across the nose and mouth to prevent breathing in extremely cold air.

Although the descriptions given in this patent paper contain many specifities, these should not be construed as limiting the scope of the invention, but as merely providing illustrations of some of the presently preferred embodiments of the invention. For example: the tie strap closure around the head can be tied, sewn, taped, or clamped in other ways than the preferred embodiment presented in this patent paper. The wiping towel can be installed and folded several different ways in the sweatband and it can be removed using tabs, pull chords, or through different style and size access openings in the sweatband.

Thus the scope of the invention should be determined by the appended claims and their legal equivalents, rather than by the examples given.

BRIEF DESCRIPTION OF DRAWINGS

FIGS. 2A-1 and 2B-1 illustrate the assembled sweatband of FIG. 1 on a wearer's head.

FIG. 4A-1 illustrates the sweatband of FIG. 4 on a wearer's head.

FIG. 4B-1 illustrates the sweatband of FIG. 4B on a wearer's head.

Figure 1:
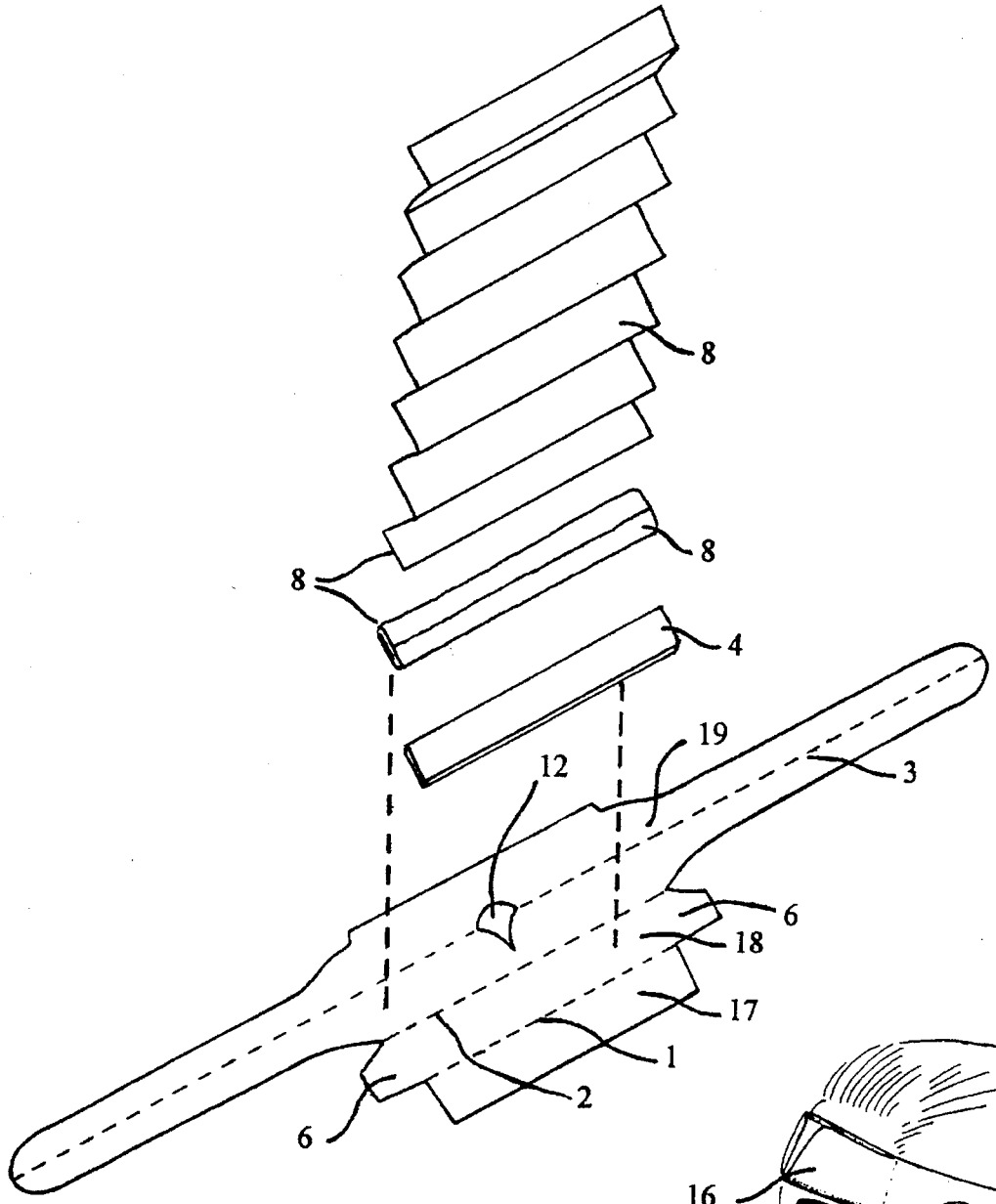
FIG. 1 illustrates the sweatband assembled, and in the preassembly, unfolded condition, with the sub-assembly parts.
Figure 1A:
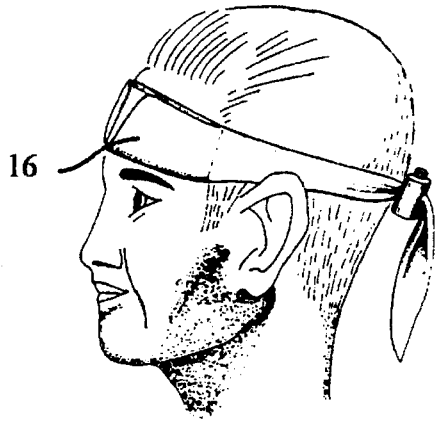
FIG. 1A illustrates the assembled sweatband of FIG. 1 on a wearer's head.
Figure 2:
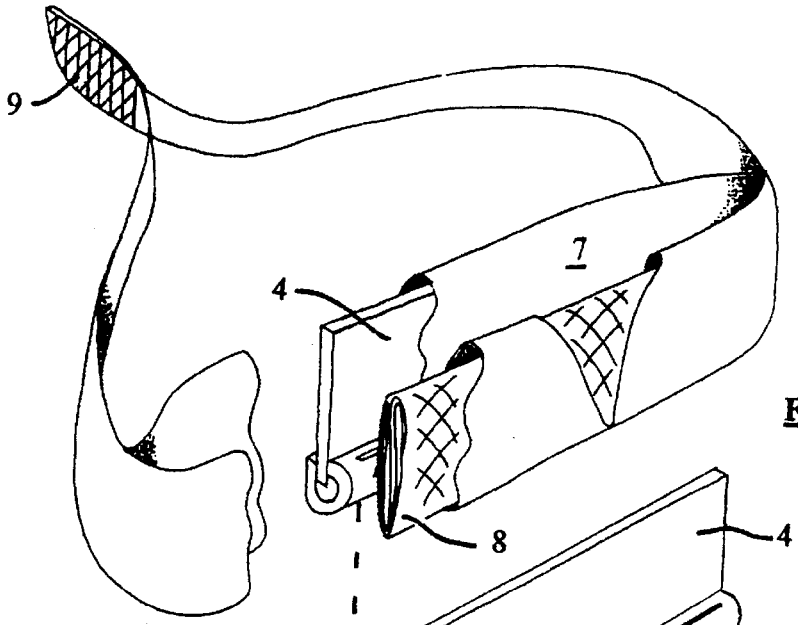
FIG. 2 illustrates the perspiration absorbing pad
Figure 3:
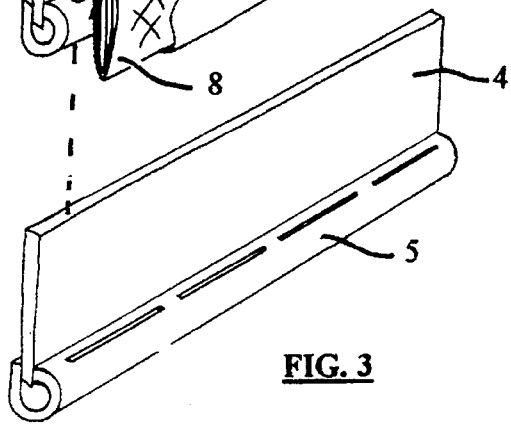
FIG. 3 illustrates the excess perspiration drain channel located at the bottom longitudinal edge of the sweatband's perspiration absorbing pad.
Figures 1, 2A:
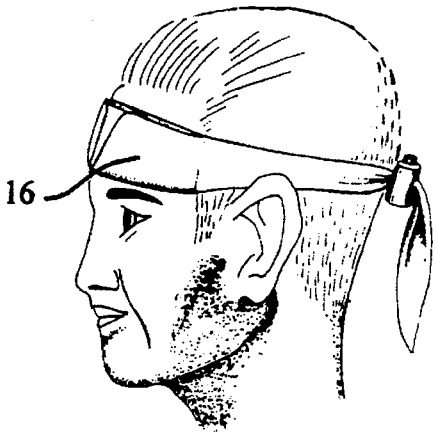
Figures 1, 2B:
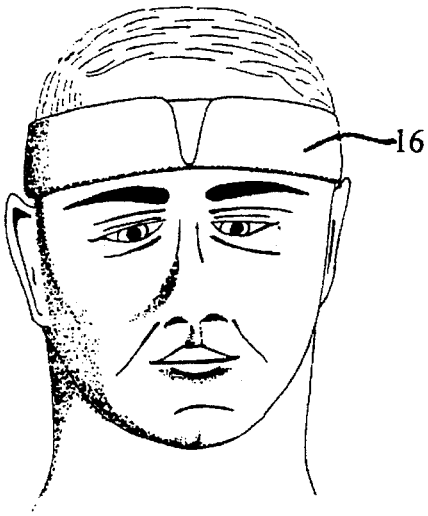
Figure 4B:
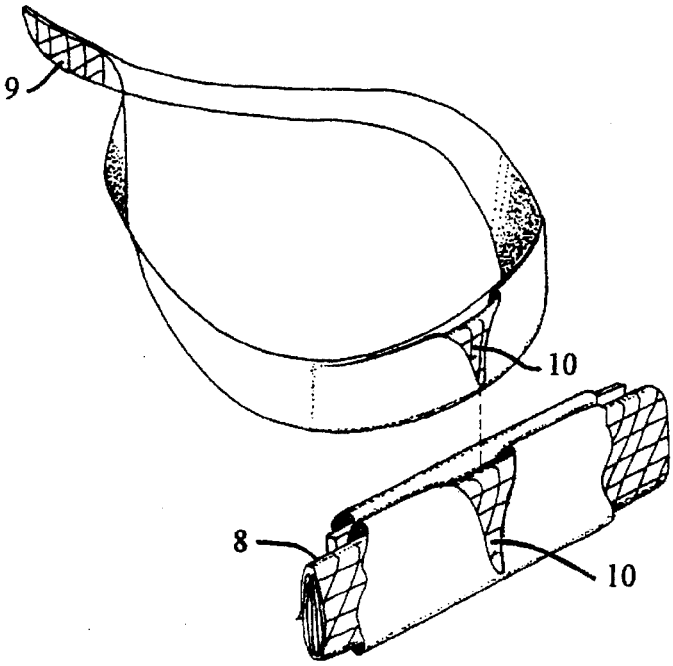
FIG. 4B illustrates an alternate style of the sweatband wiping towel access installation on the forward face of the sweatband.
Figures 1, 4B:
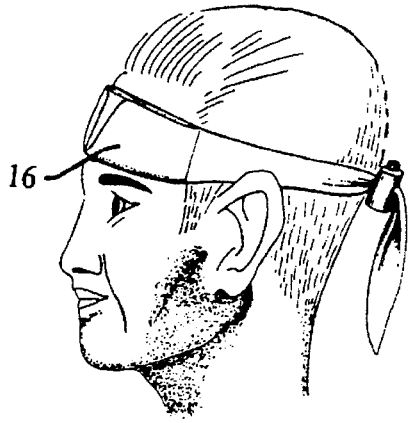
Figure 4:
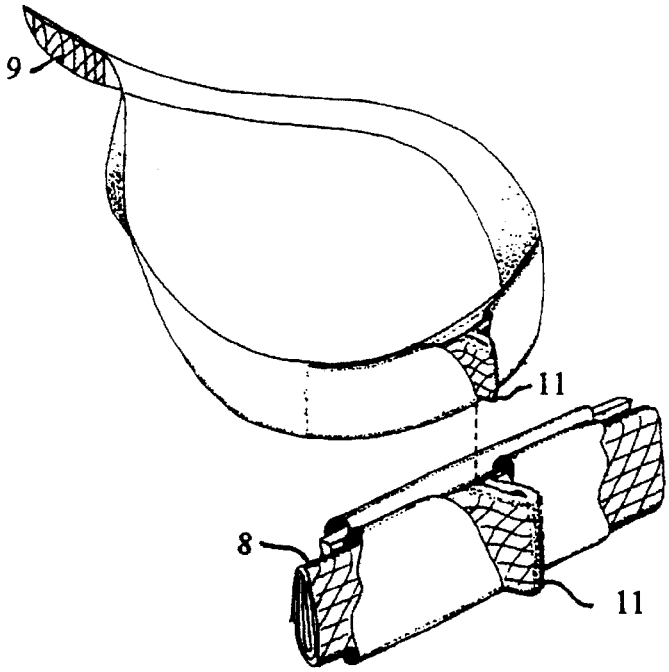
FIG. 4 illustrates one style of the sweatband wiping towel access installation on the forward face of the sweatband.
Figures 1, 4A:
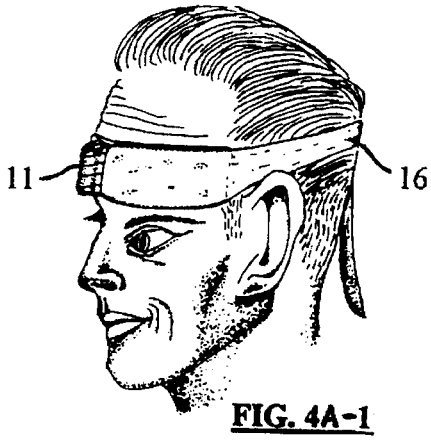
Figure 5:
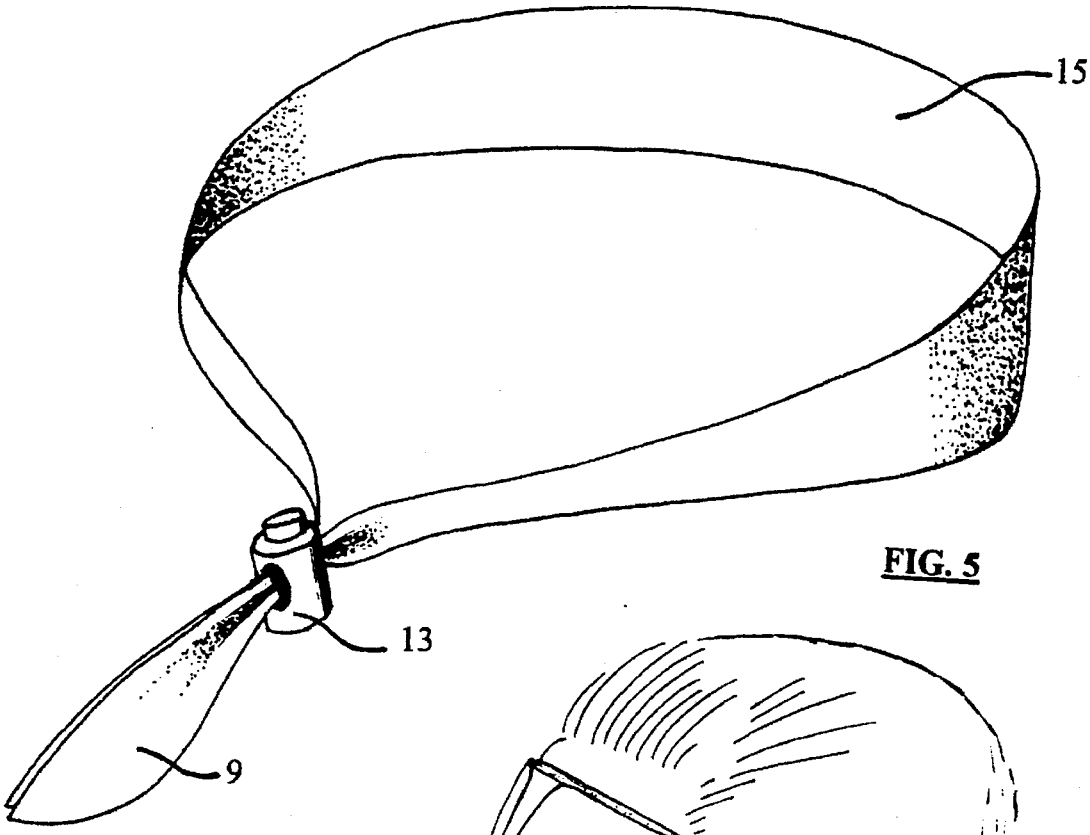
FIG. 5 illustrates the sweatband tie straps and mechanical tie strap clamping device.
Figure 5A:
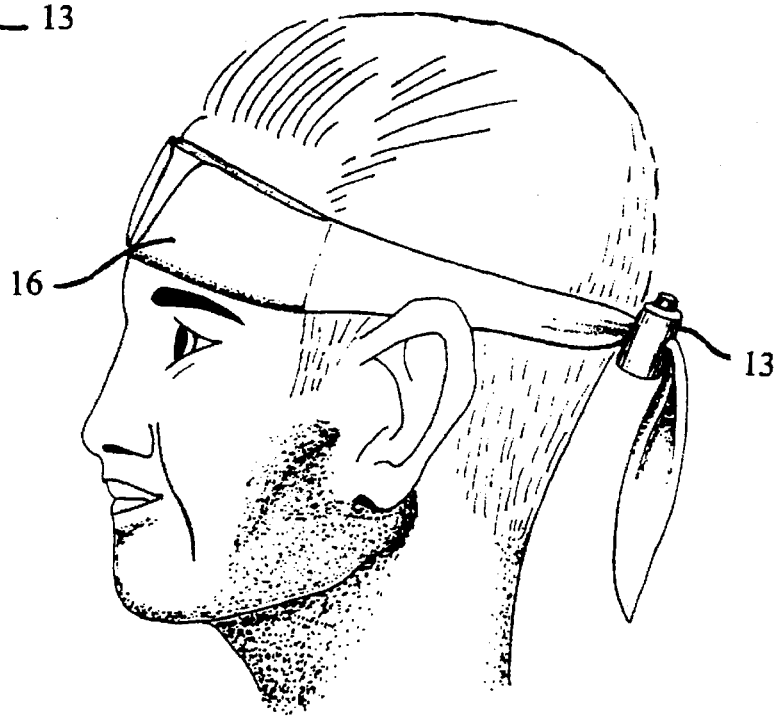
FIG. 5A illustrates the sweatband of FIG. 5 on a wearer's head.
Figure 6:
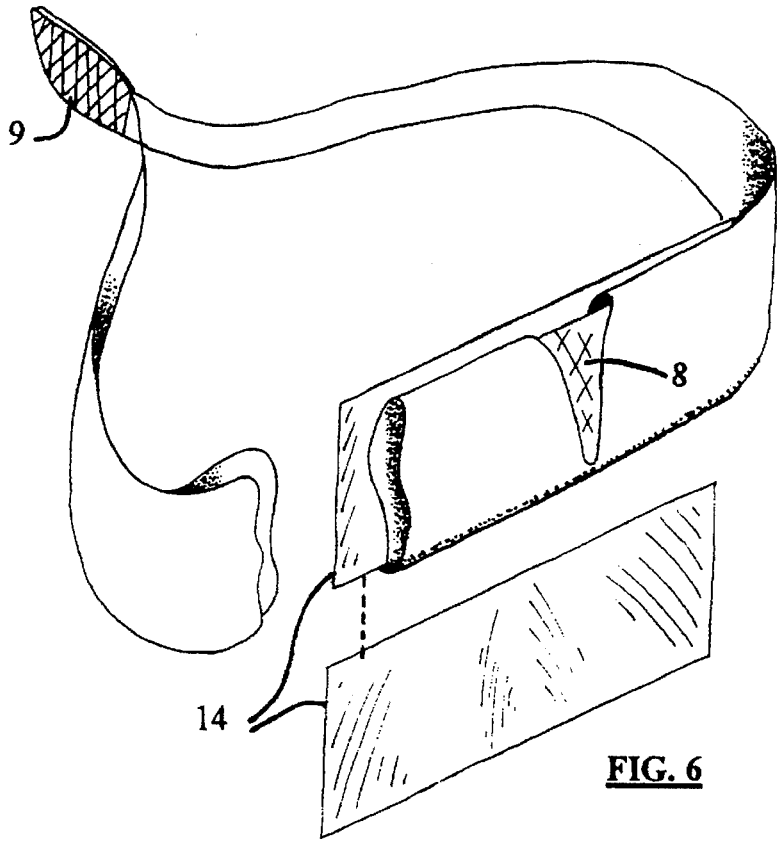
FIG. 6 illustrates the perspiration shield located in the sweatband pocket.
Figure 6A:
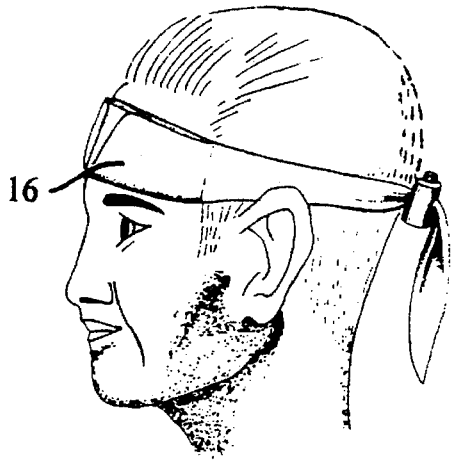
FIGS. 6A and 6B illustrate the sweatband of FIG. 6 on a wearer's head.
Figure 6B:
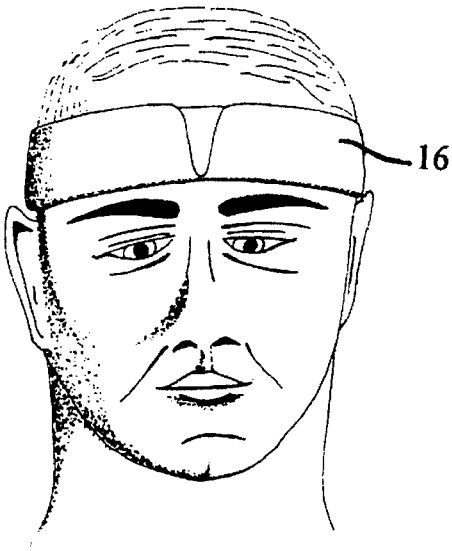

REFERENCE NUMERALS IN DRAWINGS 1 first fold line-forming the first elongated envelope
2 second fold line-forming the second elongated envelope
3 third fold line of the unitary body member
4 perspiration absorbing pad
5 drain channel on perspiration absorbing pad
6 reinforcing tabs on first elongated envelpope
7 pocket formed between the first and second elongated envelopes
8 removable wiping towel/veil/windscreen
9 tie straps with end tips combined together
10 first style of wiping towel installation placed flat in the sweatband wiping towel access opening
11 second style of wiping towel installation with tuck in the sweatband wiping towel access opening
12 sweatband removable wiping towel access opening
13 spring loaded mechanical tie strap clamping device
14 removable perspiration shield installed in sweatband pocket
15 sweatband assembled
16 sweatband worn on the head
17 lower rectangular portion
18 middle rectangular portion
19 elongated upper portion

DETAILED DESCRIPTION OF SWEATBAND

As shown in the drawings and denoted in the specifications, this sweatband creation is constructed primarily of perspiration absorbing textile materials and consists of:

A single piece of material with three distinct folds referred to as the unitary body member. The unitary member is comprised of a lower rectangular portion 17, a middle rectangular portion 18, and an upper rectangular portion 19. The middle rectangular portion is longer in length and larger in surface area than the lower rectangular portion. The elongated upper portion is more than twice as long in length as said the middle rectangular portion. The elongated upper portion is more than twice as large in surface area as the middle rectangular portion. The first fold creates the first elongated envelope 1 in the center portion of the sweatband across the wearer's forehead, which contains a perspiration absorbing pad 4 and a drain channel 5 attached to the bottom longitudinal edge of the perspiration absorbing pad 4 in order to capture any excess perspiration collected from the perspiration absorbing pad 4 and drain it to the ends of the perspiration absorbing pad 4 where it can drain down the sides of the wearer's head and away from the eyes. This drain channel 5 feature offers the wearer complete protection from forehead perspiration entering the eyes in even the most extreme perspiration cases. The second fold 2 creates the second elongated envelope across the wearer's forehead, which abuts the first elongated envelope 1 and contains a removable wiping towel 8 and provides an access opening 12 on the front face of the sweatband for easy removal of the wiping towel. Two styles of removable wiping towel installations are provided. The first style 10 of the removable wiping towel installation in the sweatband shows the removable wiping towel in the flat position within the sweatbands second elongated envelope. The second style 11 installation of the removable wiping towel in the sweatband shows the removable wiping towel protruding with a tuck from the access opening 12 in order that the wiping towel may be grasped more easily from the access opening 12. The third fold 3 covers the entire length of the sweatband, doubling each tie strap 9 together and brings the reinforcing tabs 6 from the first elongated envelope in contact with the inside of the tie straps 9 which extend outwardly on a longitudinal plane from the ends of the second elongated envelope to form a loop by combining the tie strap end tips 9 together. The third fold 3 also creates a top opening pocket 7 across the wearer's forehead, which is formed between the abutting first elongated envelope 1 and the second elongated envelope 2. A removable perspiration shield 14 is placed in the sweatband pocket 7 to prevent the wearer's perspiration from saturating the folded removal wiping towel 8 which is contained within the second elongated envelope. The perspiration shield 14 can be easily removed by hand from the sweatband pocket 7 while wearing the sweatband to allow the removable wiping towel 8 to become saturated with the wearer's perspiration if the wearer prefers to have the advantages of a wet wiping towel 8. The spring loaded mechanical tie strap clamping device 13 holds the tie straps 9 tight around the wearer's head and can be easily used to adjust the tension of sweatband around the wearer's head with one hand while wearing the sweatband 15.

The sweatbands ability to adjust to all human head sizes is further enhanced by the sweatbands ability to adjust the tension of the sweatband on any wearer's head size, at any time, with one hand, while the sweatband is being worn. This is accomplished by using the left and right side sweatband tie straps surrounding the head and combining them together in the back of the wearer's head through a mechanical spring loaded clamping device. Both sweatband tie strap end tips are also attached evenly together in order to allow the wearer to easily grasp and pull on the combined tie strap end tips as a single pulling point in order to center the sweatband on the wearer's forehead with an even tension being applied on both tie straps around the head at the same time. The attachment makes the combined tie strap end tips semi-rigid thereby allowing the sweatband wearer to easily tuck the excess tie strap material formed after securing the sweatband on the head back between the wearer's head and the sweatband tie strap portion surrounding the head, if the wearer chooses not to have the loose tie strap material protruding like a pony tail from the sweatbands mechanical tie strap clamping device, in back of the head. The sweatbands removable wiping towel provides the wearer with either a wet or dry wiping towel to remove perspiration and other elements both on or off the wearer's body. The removable wiping towel will usually be wet from the wearer's perspiration if the perspiration shield is removed prior to using the sweatband, therefore, it can also provide the wearer with a see through moistened veil to cover the face, neck and other parts of the body. As the moisture evaporates from the wiping towel close to the skin, it provides a cooling effect to the body. The wiping towel can be easily removed from the sweatband while the sweatband is being worn and unfolded for use with only one hand. The two styles of wiping towel installations provided in the second elongated envelope of the sweatband allows the wearer to choose a sweatband with a wider removable wiping towel that can be more easily grasped by the hand and pulled out from the sweatband by the tuck formed in the wider removable wiping towel which extends out from the wiping towels access opening on the forward face of the sweatbands second elongated envelope. The other style wiping towel installation in the sweatband offers a smaller removable wiping towel installation which is perhaps more stylish but slightly less accessible without the extended tuck feature. It places the entire wiping towel in its folded flat position in the second elongated envelope, where it can also be easily removed by pinching and pulling the wiping towel from the sweatband access opening on the forward face of the second elongated envelope. The sweatbands top opening pocket formed between first elongated envelope and the second elongated envelope of the sweatband also allows the wearer a means for carrying identification, money, and other desirable items. In cold weather this sweatband creation may be used to provide the wearer with comfort and warmth as it protects the wearer from the cold effects of the weather. The wiping towel can be removed and used as a nose wipe or windscreen and may be folded or bunched together and held across the nose and mouth to prevent breathing in extremely cold air which could damage the lungs. The sweatband can be folded into a small packet carrying size for various types of packaging and may be considered as being disposable on a economical and practical basis. The sweatband is removed from its packaging, unfolded and placed loosely around the wearer's head with the sweatband pocket facing up. The first elongated envelope, containing the perspiration absorbing pad, goes against the wearer's forehead, forming the inside envelope with the second elongated envelope, containing the removable wiping towel and its access opening forming the outside envelope of the sweatband. The centers of sweatbands perspiration absorbing pad, contained in the first elongated envelope and the removable wiping towel, contained in the second elongated envelope, are positioned in the center of the wearer's forehead. The sweatband is then tightened about the wearer's head by pulling on the combined sweatband tie strap end tips which pass through and beyond the mechanical tie strap clamping device. The tension on the sweatband around the wearer's head can be easily relieved by depressing the spring loaded plunger button on mechanical tie strap clamping device with the fingers. The sweatbands removable wiping towel is easily removed from the sweatband by pinching and pulling out on the exposed portion of the removable wiping towel from its opening located on the outside face of the second elongated envelope. Once removed, the wiping towel can be squeezed in the removed folded position to release the accumulated perspiration and then unfolded with one hand for multipurpose applications by the wearer. Two adjacent corners of the removed wiping towel can be tucked between the sweatband and the wearer's forehead in order to hold the wiping towel in the sweatband across the face or over the head like a veil. In this way the wiping towel serves as a cooling, sun protective head cover or a see through face cover, or as a windscreen in cold weather. The removed wiping towel can also be tucked into the back of the sweatband in order to protect the back of the users neck from the effects of the sun. The sweatband can be easily removed from the wearer's head by grasping the sweatband with one hand and pulling or pushing the sweatband upward off the head or by releasing the tension on the sweatband with the use of the mechanical tie strap clamping device and grasping the combined sweatband tie strap end tips and pulling upward, removing the sweatband from the head.

I claim:

1. A combination sweatband and removable wiping towel adapted to be wrapped about the upper head of a wearer comprising:

a unitary body member comprised of a single piece of material having a lower rectangular portion a middle elongated portion and a elongated upper portion having an access opening therein, an upper portion of the access opening being rounded and a remaining lower portion of the access opening being cone-shaped, the middle elongated portion being longer in length and larger in surface area than the lower rectangular portion, said elongated upper portion being more than twice as long in length as said middle elongated portion, said elongated upper portion being more than twice as large in surface area as said middle elongated portion, said elongated upper portion having two end portions which form two tie straps;

a first fold line formed adjacent an upper edge of the lower rectangular portion and adjacent a lower edge of said middle elongated portion, a second fold line formed adjacent an upper edge of said middle elongated portion and adjacent a lower edge of said elongated upper portion, a third fold line formed through an approximate center of said elongated upper portion adjacent a lower edge of said upper portion of said access opening and adjacent an upper edge of said remaining lower portion of said access opening, said third fold line extending from one of said two end portions of said elongated upper portion to the other of said two end portions of said elongated upper portion;

said unitary body member being folded along said first fold line to form a first envelope, said unitary body member being folded along said third fold fine to form a second envelope, said unitary body member being folded along said second fold line to form a pocket between said first envelope and said second envelope;

said first envelope containing a rectangular perspiration absorbing pad having an arcuate drain channel attached to a bottom edge thereof, said second envelope containing a folded wiping towel, said pocket containing a removable perspiration shield;

whereby said folded wiping towel of said second envelope can be readily removed from said access opening when said unitary body member of said sweatband is wrapped about a wearer's head with the first envelope being positioned directly adjacent the wearer's forehead.

* * * * *